United States Patent [19]

Buck et al.

[11] 4,291,663

[45] Sep. 29, 1981

[54] BALL THROWING MACHINE

[75] Inventors: Gordon H. Buck, Torrance; Otto L. Gabler, Lawndale; Eugene J. Kilroy, Palos Verdes Estates; Richard Leoncavallo, Anaheim, all of Calif.

[73] Assignee: Mattel, Inc., Hawthorne, Calif.

[21] Appl. No.: 118,140

[22] Filed: Feb. 4, 1980

[51] Int. Cl.[3] ..... F41B 7/00

[52] U.S. Cl. ..... 124/26; 124/29; 124/37; 124/41 R; 124/83

[58] Field of Search ..... 124/29, 27, 38, 37, 124/41 R, 81, 83, 26, 21; 46/74 R, 74 A, 84

[56] References Cited

U.S. PATENT DOCUMENTS

| | | | |
|---|---|---|---|
| 368,307 of | 0/1887 | Rhodes | 46/84 X |
| 2,474,054 | 6/1949 | Jones | 124/29 |
| 2,784,711 | 3/1957 | Vaughn | 124/27 X |

FOREIGN PATENT DOCUMENTS

| | | | |
|---|---|---|---|
| 11431 | 12/1909 | France | 124/26 |
| 424639 | 3/1911 | France | 124/26 |
| 11306 | of 1910 | United Kingdom | 124/26 |

*Primary Examiner*—Richard C. Pinkham
*Assistant Examiner*—William R. Browne
*Attorney, Agent, or Firm*—Reagin & King

[57] ABSTRACT

A machine for throwing a ball with a cylindrical aperture. The machine comprises an arrangement for mounting a rod which carries the ball and which is rotatably mounted to fall from an initial vertical position to a selected angular position after a preselected period. At the selected angular position, a spring drive projects the ball through the air. In a preferred embodiment the ball, which may be of any type, is projected with a spiral motion.

10 Claims, 9 Drawing Figures

BALL THROWING MACHINE

BACKGROUND OF THE INVENTION

This invention relates to athletic training machines and, more particularly, to a ball throwing machine.

There have been a number of throwing machines devised. A number of such machines are described in W. C. Hinman U.S. Pat. No. 221,306, issued Nov. 4, 1879; M. Warne U.S. Pat. No. 228,959, issued June 15, 1880; W. Webber U.S. Pat. No. 1,091,992, issued Mar. 31, 1914; A. McMillan U.S. Pat. No. 1,203,027, issued Oct. 31, 1916; H. G. Boardman U.S. Pat. No. 1,204,645, issued Nov. 14, 1916; H. R. Maxcey, Jr. et al U.S. Pat. No. 2,767,985, issued Oct. 23, 1956; V. C. Weidmaier et al U.S. Pat. No. 3,044,776, issued July 17, 1962; O. K. Pankratz U.S. Pat. No. 3,277,878, issued Oct. 11, 1966; W. S. Jurkiewicz Pat. No. 3,399,892, issued Sept. 3, 1968; R. E. Lee U.S. Pat. No. 3,410,258, issued Nov. 12, 1968; H. O. Wegner U.S. Pat. No. 3,611,996, issued Oct. 12, 1971; J. R. Dixon U.S. Pat. No. 3,951, 125, issued Apr. 20, 1976; and B. C. Meyer U.S. Pat. No. 3,977,386, issued Aug. 31, 1976. Such machines are usually used to train athletes in the particulars of a sport such as baseball, tennis, or football. In general, such a machine supplants a human player and throws a ball to a particular position so that the athlete utilizing the machine may receive training in catching, batting, hitting, and the like without the presence of another player. Such machines can also often be used by one or more athletes as training games. However, most such machines are able to vary the throw of the ball only within narrow limits so such a training game quickly becomes boring. Furthermore, no known prior art machine is capable of functioning as a training device for a number of different sports such as basketball and football.

It is an object of this invention to provide a new and improved ball throwing machine.

It is another object of this invention to provide a ball throwing machine which is adjustable from throw to throw for both distance and direction.

It is still another object of this machine to provide an adjustable ball throwing machine capable of functioning for a number of different sports.

SUMMARY OF THE INVENTION

These and other objects of the invention are accomplished by a ball throwing machine which utilizes a ball having a cylindrical aperture therethrough. The ball is placed on a rod rotatably affixed to a base by means which allow the rod to be aimed in both the vertical and horizontal planes. The rod is initially pointed vertically. When released by a timer, the rod falls to a selected vertical horizontal position from which the ball is projected by a spring drive. Any number of different balls may be used with the device although a preferred embodiment has means for imparting a spiral motion which is especially useful in throwing a football. The initial vertical position of the rod and a cover for the base hide the ultimate direction in which the ball is to be thrown and make the machine especially useful in playing athletic games.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
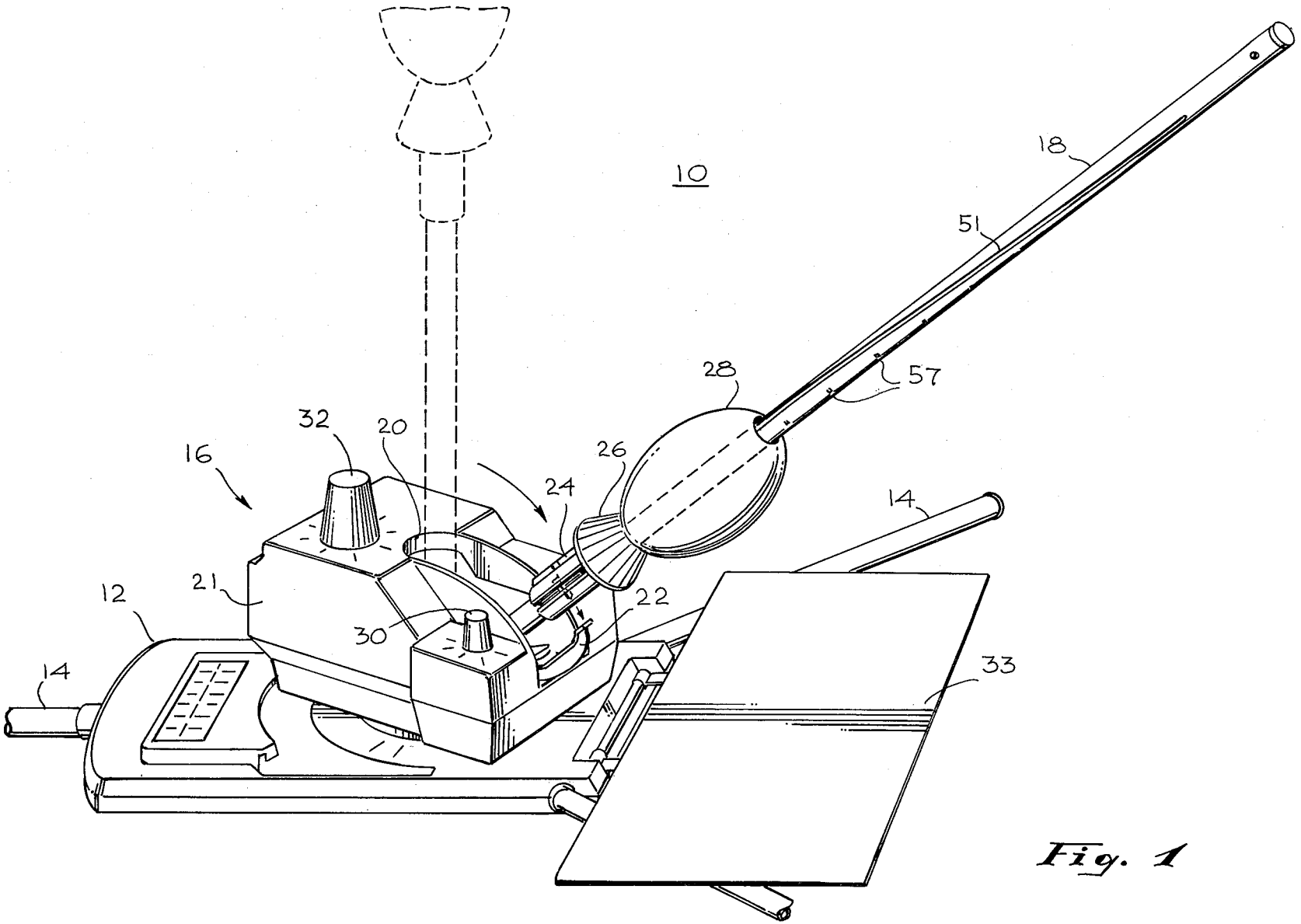
FIG. 1 is a perspective view of a ball throwing machine constructed in accordance with the invention.

Referring now to the drawings and, more particularly, to FIG. 1, there is shown a perspective view of a ball throwing machine 10 constructed in accordance with the invention. The machine 10 includes a base 12 having projecting therefrom in a generally horizontal direction three legs 14 which form a sturdy support for the machine 10. Rotatably mounted to the upper portion of the base 12 is a launching assembly 16 from which projects a rod 18. The rod 18 projects through an aperture 20 in the upper and frontal surface of a housing 21 for the launching assembly 16. Also projecting through the aperture 20 is a trigger operating device 22.

Mounted to and surrounding the rod 18 is a launcher 24 which impels a sponge ring 26 having an upper surface which is a frustum of a cone. The ring 26 urges a ball 28 (which has a cylindrical aperture therethrough) upward along the rod 18 when the trigger operating device 22 releases the launcher 24. The launcher 24 travels under spring power along the rod 18 toward the free end thereof. The force of the launcher 24 impels the ball 28 upward away from the machine 10 at the particular vertical and horizontal angles selected.

Selection of the vertical and horizontal angles is accomplished by rotating the launching assembly 16 on base 12 to select a horizontal angle and turning a knob 30 to select a vertical angle. The horizontal angle determines the direction in which the ball 28 is thrown, and the vertical angle determines the range of the ball 28. A timing knob 32 is positioned on the upper surface of the housing 21 of the launching assembly 16 and actuates a timing mechanism (the operation of which is explained hereinafter) which actuates the release of the trigger operating device 22.

In operation, the rod 18 projects directly upwardly from the launching assembly 16, as shown in dotted lines in FIG. 1, so that one viewing the machine 10 will be unable to determine in which direction the rod 18 will ultimately point by looking only at the rod 18. If used as a game, the machine 10 may have a cover 33 rotatably hinged to the base 12 which may be raised to mask the front of the launching assembly 16. The cover 33 drops from the raised position as the rod 18 falls into the launching position. In order to select the direction of the ball, the launching assembly 16 is first pivoted to the correct horizontal angle at which the ball is to be directed. The knob 30 is then adjusted to pick the particular vertical angle at which the rod 18 is to project to determine the range to which the ball 28 is to be thrown. Next, the timing knob 32 is adjusted to select a particular time delay before the mechanism is to be operated. Depressing the knob 32 starts the time running; and, after the particular selected period has passed (two to ten seconds in a preferred embodiment), the rod 18 drops into its firing position, and the trigger operating device 22 presses against the trigger (not shown in FIG. 1) of the launcher 24. This releases the launcher 24 which is spring driven to impel the ball 28 along the length of the rod 18 and cause it to be thrown in a line in the direction of the axis of the rod 18.

The inclusion of the cover 33 and of a timing mechanism allows the machine 10 to launch a football pass in a masked direction in a time selected by the operator of the machine. This allows two people to play a game in which one defends against the pass of the ball 28 while another attempts to receive the ball 28. By using different types of balls, the machine 10 may be used for the reception of football passes, tennis lobs, baseball flies, and the like.

Figure 2:
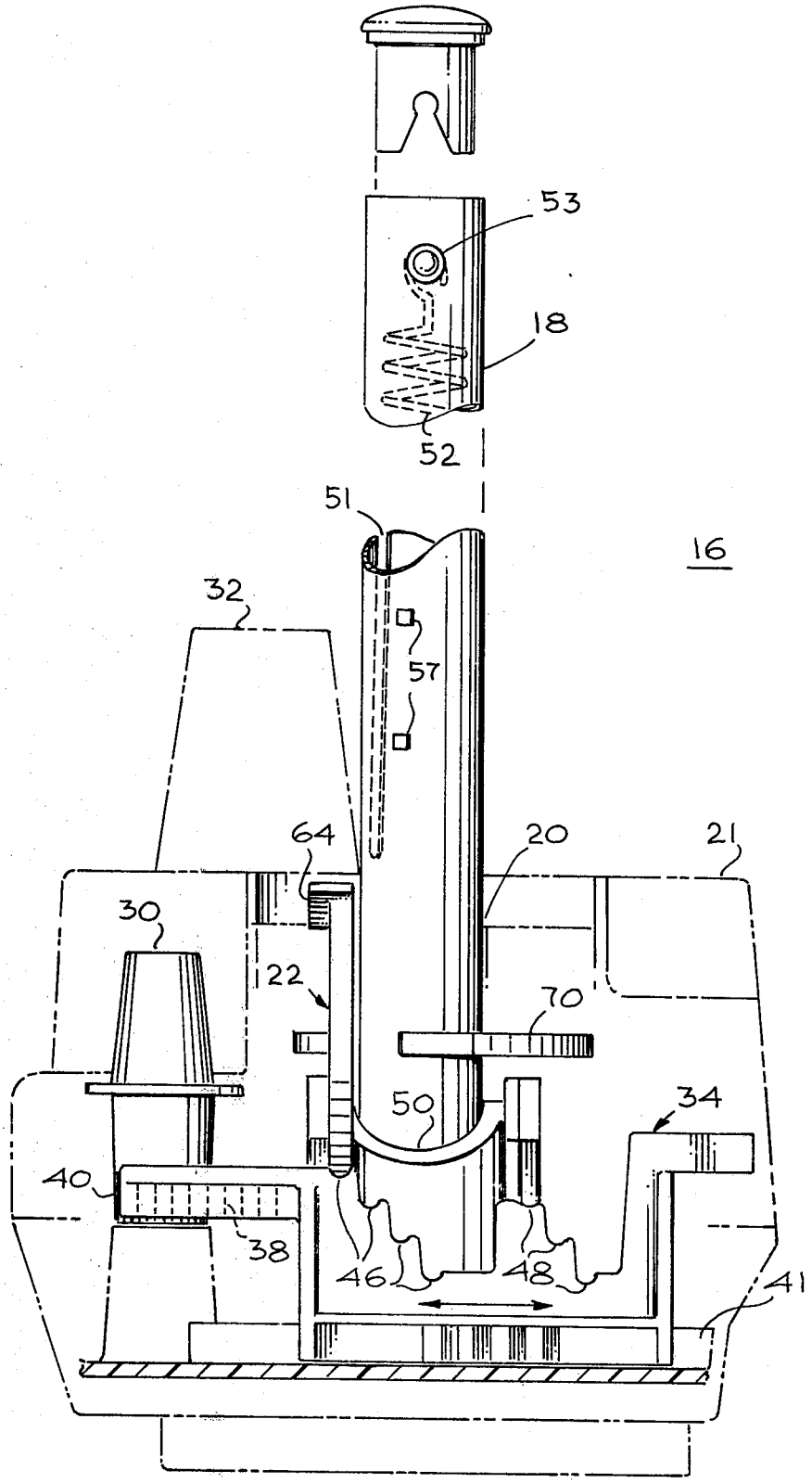
FIG. 2 is a front view, partially cut away, of the ball throwing machine shown in FIG. 1.
Figure 3:
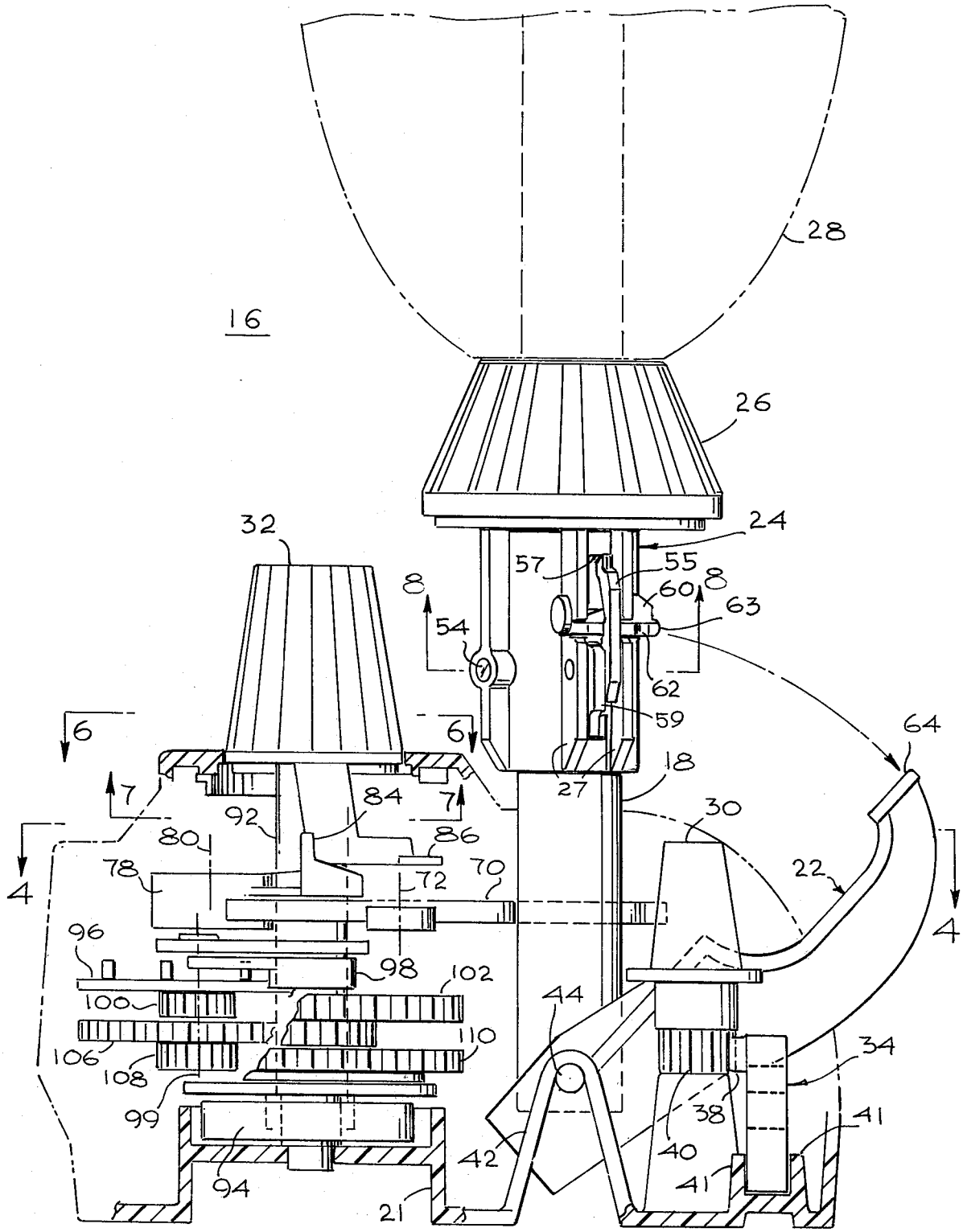
FIG. 3 is a side view of the interior mechanism of the ball throwing machine shown in FIG. 1.
Figure 4:
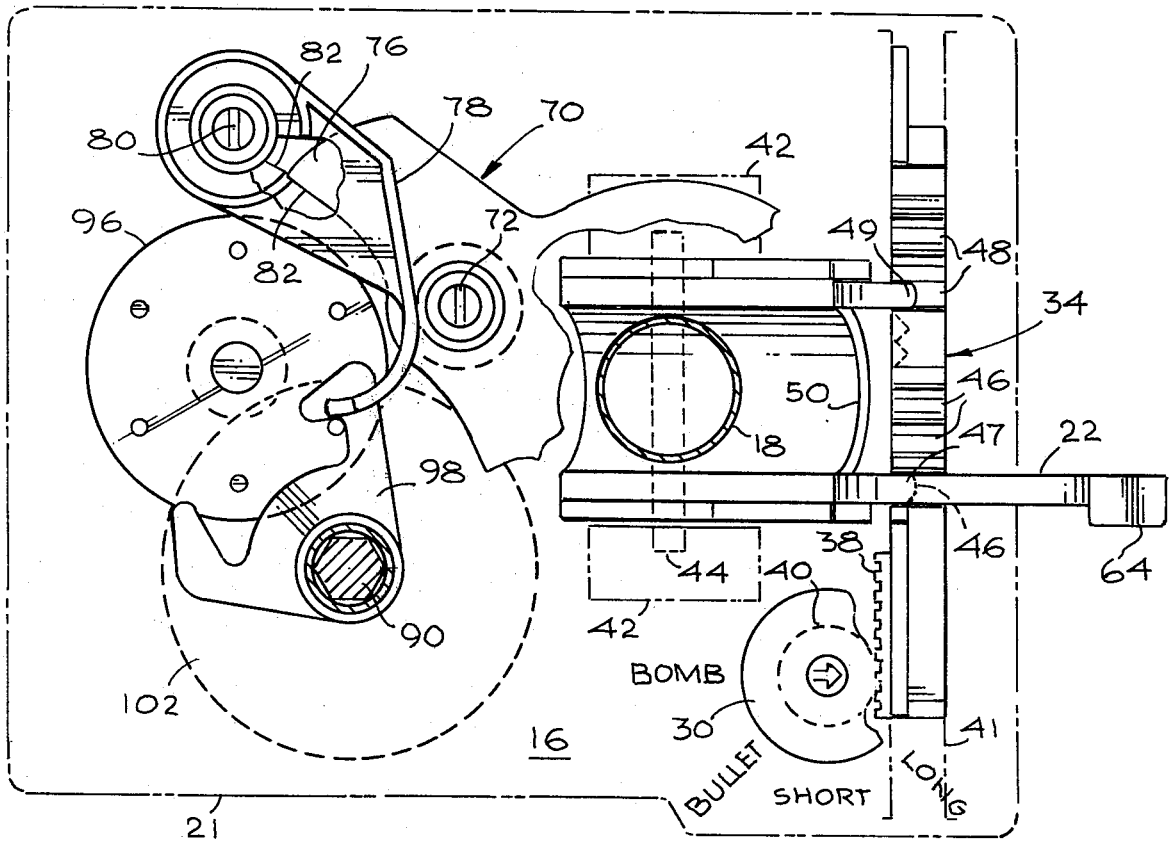
FIG. 4 is a top view of the interior of the ball throwing machine shown in FIG. 1.

Referring now to FIGS. 2, 3, and 4, there are shown respectively front, side, and top views of the launching assembly 16 shown in FIG. 1 which accomplishes the throwing of the ball 28 as described in FIG. 1. The assembly 16 contains a slide 34 which lies in a vertical plane and is positioned across the lower front portion of the aperture 20 in the housing 21 of the assembly 16. This slide 34 has on its inner surface a gear facing 38 which meshes with a spur gear 40 mounted to rotate with the knob 30. Thus, the rotation of the knob 30 causes the slide 34 to move across the aperture 20 sliding in upstanding projections 41 extending from the lower surface of the housing 21 of the assembly 16. The slide 34 has molded in its upper surface a number of detents 46 and 48 at different heights which, as will be explained, determine the angle to which the rod 18 and the trigger operating device 22 will fall when operated.

As shown in FIGS. 3 and 4, the rod 18 and the trigger operating device 22 are each rotatably mounted to projections 42 extending from the bottom of the housing 21 by a pin 44. The trigger operating device 22 is shaped with two projections 47 and 49 each of which is shaped to mate with the detents 46 and 48, respectively. These projections 47 and 49 are adapted to mate with the selected detents 46 and 48 in the slide 34 to stop the fall of the trigger operating device 22 thereby to determine the ultimate position to which the rod 18 may fall. The shape of an interior rounded surface 50 of the device 22 which faces the rod 18 is such that it lies adjacent and cradling the rod 18 in the vertical position, slightly separated therefrom. When the device 22 and the rod 18 are released, they rotate on the pin 44 until the device 22 reaches the point where it stops against the detents 46 and 48. The particular position is determined by the rotation of the knob 30 which positioned selected ones of the detents 46 and 48 under the projections 47 and 49. As the device 22 stops, the rod 18 continues to fall with a force sufficient to contact the surface 50 to operate the trigger mechanism 24.

Figure 8:
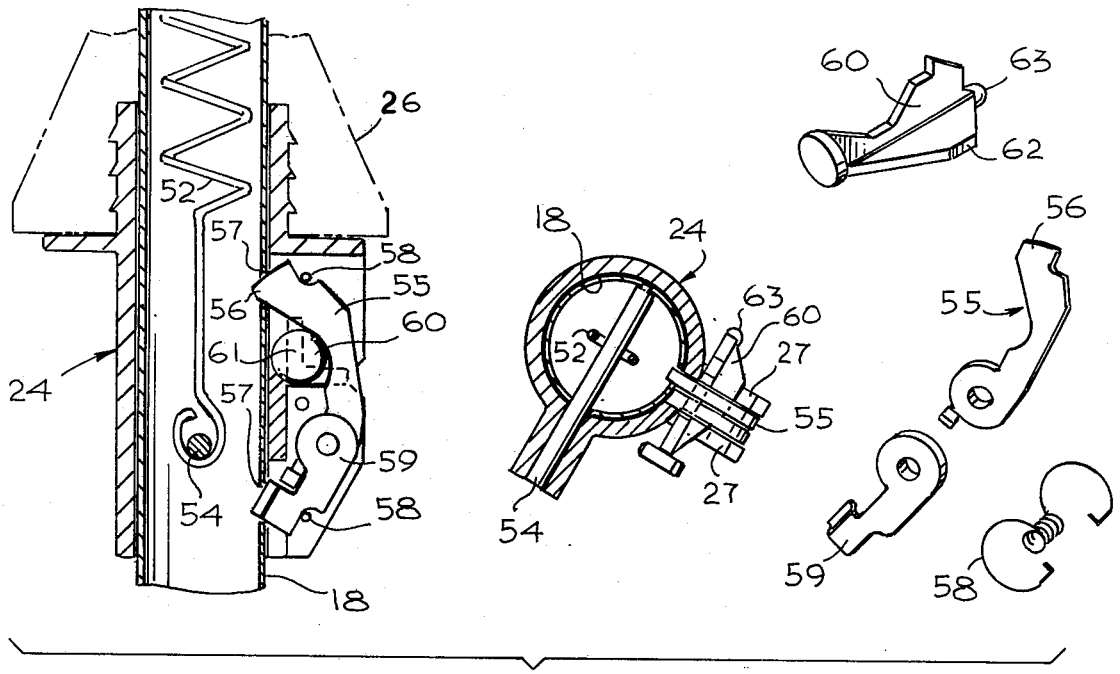
FIG. 8 illustrates details of a release mechanism used in the ball throwing machine shown in FIG. 1.

As is shown in FIGS. 1 and 2, the rod 18 is a hollow cylinder with a long, thin aperture 51 describing a portion of a helical path about its exterior. Inside of the rod 18 is a spring 52 which is connected to the upper end of the rod 18 by a pin 53. The other end of the spring 52 is connected by a pin 54 to a platform 25 of the launcher 24. The pin 54 extends through the aperture 51 so that the platform 25 of the launcher 24 is effectively connected by the spring 52 to the upper end of the rod 18. A trigger 55 (see also FIG. 8) is rotatably mounted to a pair of projections 27 from the platform launcher 24 and has a finger 56 which projects against the surface of the rod 18 so that it fits into a number of apertures 57 in the rod 18 which describe a helical path lying alongside that of the aperture 51 but displaced by a small amount. A spring 58 bears against the upper surface of the trigger 55 so that when the launcher 24 is pressed downwardly along the axis of the rod 18, the finger 56 is pushed in against the surface of the rod and thus will hold the launcher 24 in any of the positions defined by the apertures 57. The spring 58 also bears against a noise making lever 59 which is rotatably mounted by the projections 27. This allows a child to cock the launcher 24 in increments even though he has not sufficient strength to push the launcher 24 the entire length of the rod 18 against the spring 52. With each increment, the lever 59 clicks. The trigger 55 is released by the operation of a slide 60 which fits within an aperture 61 in the launcher 24. The slide 60 has a ramp surface 62 which bears against the lower surface of the trigger 55 adjacent the rod 18 and lifts the trigger 55 when the slide 60 is moved downward to the left, as shown in the center detail of FIG. 8. The slide 60 is impelled to the left when an end 63 is stuck by a projecting arm 64 of the trigger operating device 22. This drives the slide 60 so that the ramp surface 62 forces the trigger 55 out of an aperture 57 releasing the launcher 24. It should be noted that in the preferred embodiment the launcher 24 travels a helical path described by the aperture 51 so that a spin is imparted to the ball.

Figure 6:
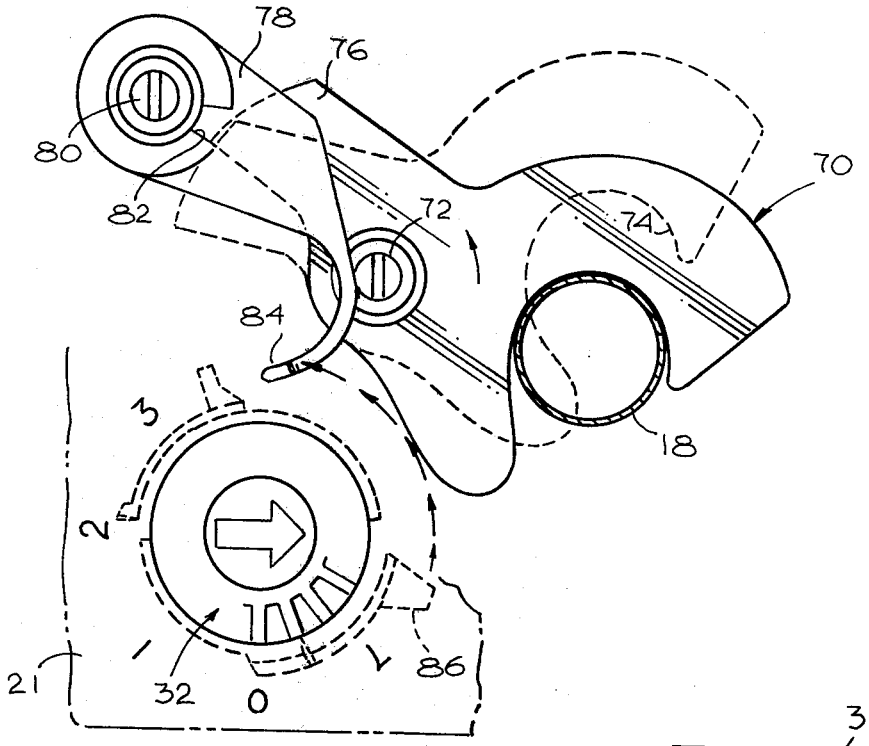
FIG. 6 is another top view of the interior of the ball throwing machine shown in FIG. 1 illustrating the cooperation of certain of the portions thereof.

As pointed out above, the device 22 operates the trigger 55 to release the launcher 24 and throw the ball 28 only when the tube 18 is released from the vertical and falls against the trigger operating device 22. This release is accomplished by the action of a latch 70 (shown in FIGS. 4 and 6) which is mounted by a pivot 72 to the housing 21 of the launching assembly 16. The latch 70 has a mouth 74 configured to wrap around and engage the rod 18 so that the rod 18 cannot move from the vertical. The latch 70 also has an end 76 opposite the mouth 74 which projects beyond the pivot 72 and is constrained to retain the latch 70 in position surrounding the rod 18 by a release arm 78. The arm 78 is mounted to the housing 21 of the assembly 16 at pivot point 80 and has a stop 82 which holds the end 76 in position so that mouth 74 engages the rod 18. When the arm 78 is rotated about pivot 80 in a clockwise direction, it moves the stop 82 to release the end 76, allowing the latch 70 (which is urged by a spring at pivot 72, not shown) to swing out of the way of the rod 18 (as shown in FIG. 6) while pushing the rod 18 so that it will fall from the vertical. The release arm 78 has molded at one end a projection 84 which is moved by a timing trigger 86 (shown in FIG. 6) so that the arm 78 pivots clockwise to release the latch 70. A spring at the pivot 80 (not shown) returns the arm 78 to the latching position upon completion of the operation.

Figure 5:
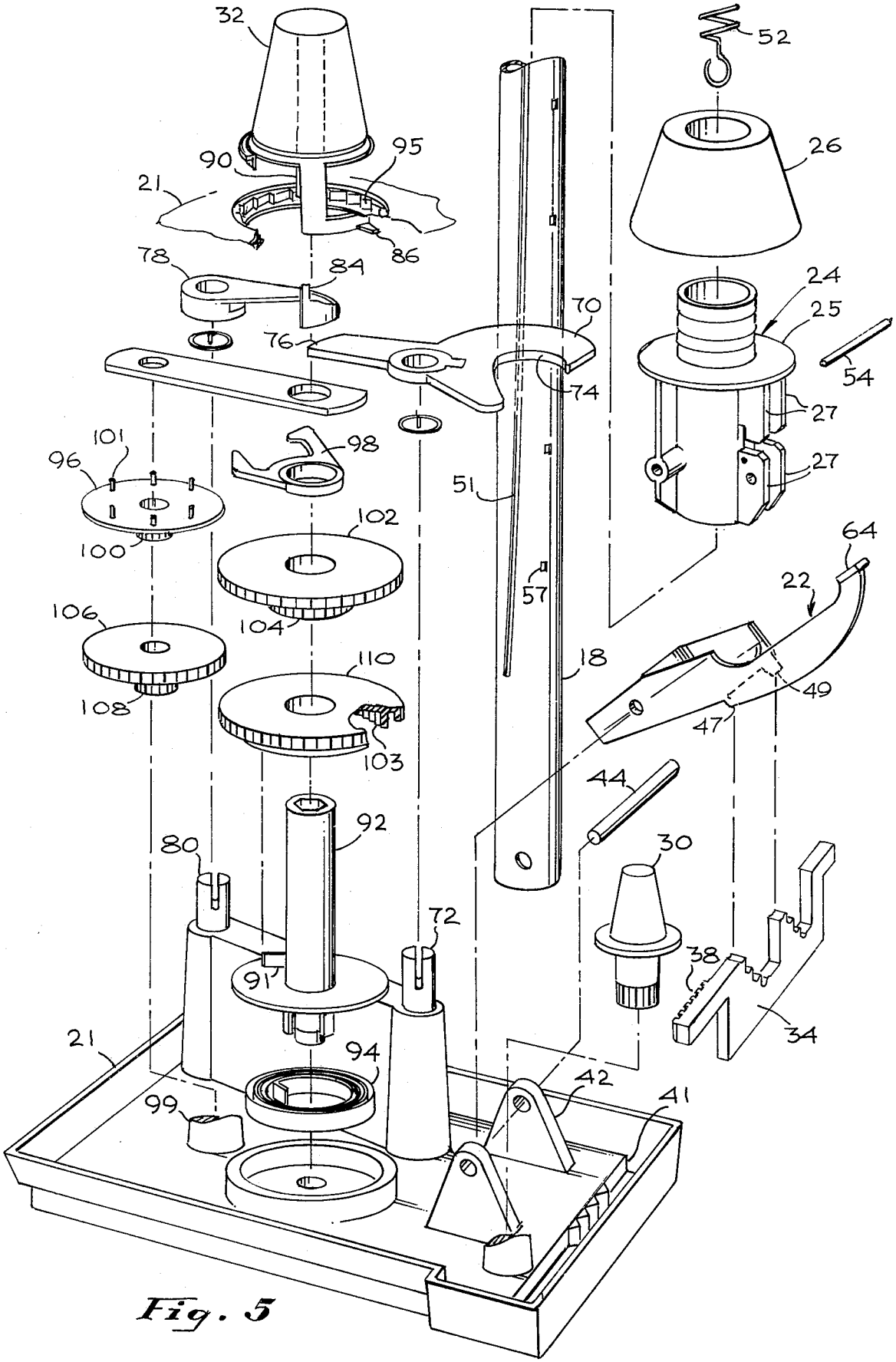
FIG. 5 is an exploded perspective view of the ball throwing machine shown in FIG. 1.

The timing trigger 86 is operated in response to rotation of the timing knob 32. The timing knob 32 sits on top of the housing 21 of launching assembly 16 and has a stub (see FIG. 7A and 7B) shaft 90 projecting therethrough. The shaft 90 is hexagonal in shape and is keyed to fit into the upper end of a cylindrical shaft 92 (see FIG. 5) which is connected to be driven by a spring 94.

Figure 7A:
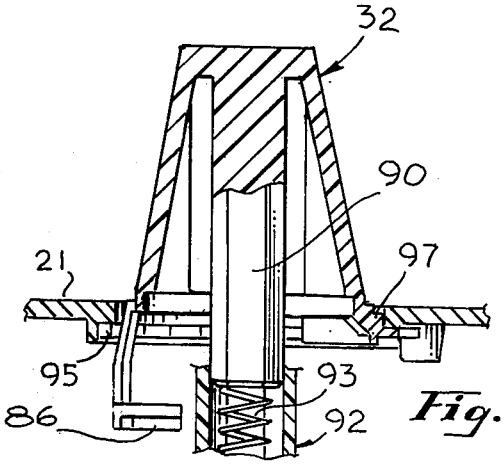
FIGS. 7A and 7B include bottom and side views of a detail of the interior mechanism of the ball throwing machine shown in FIG. 1.
Figure 7B:
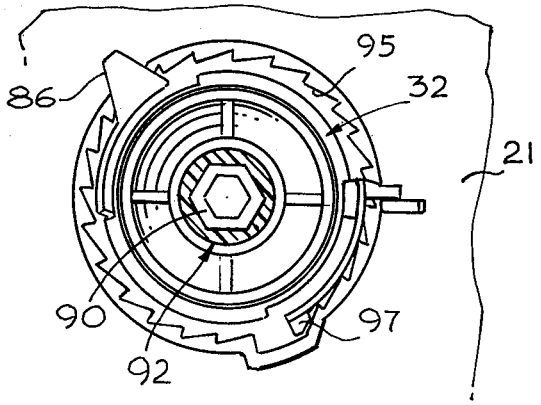

The knob 32 is normally held upward by a spring 93. By turning the knob 32 in the counter-clockwise direction, the shaft 92 is rotated and the spring 94 is wound and held ready to operate the timing mechanism. FIGS. 7A and 7B illustrate the rachet arrangement of teeth 95 and projection 97 from knob 32 by which the knob 32 is held in the wound position. The speed of the timing mechanism is controlled by an escapement arrangement including an escapement wheel 96 mounting projections 101 and a verge 98 which rotate on a shaft 99. The escapement wheel 96 is fixed to and rotates with a spur gear 100. The gear 100 is driven by a gear 102 mounted to rotate freely on the shaft 92. The gear 102 is fixed to and rotates with a second spur gear 104. The spur gear 104 is coupled to a gear 106 which is fixed to and rotates with a gear 108. The gear 108 is coupled to a gear 110 to rotate with the shaft 92.

When the timing knob 32 is rotated to rotate the shaft 92 and wind the spring 94, the shaft 92 rotates freely with respect to the gear 110 because of a gear and ratchet arrangement on the bottom thereof including a projection 91 and teeth 103. When the knob 32 is depressed, the projection 97 is pushed below and disengaged from the rachet teeth 95 so the knob 32 and the shaft 92 turn freely in the clockwise direction. This rotation causes the tooth 91 connected to the shaft 92 to engage the gear 103 and drive the gears 108, 106, 104, and 102. The rotation of gear 102 drives the escapement wheel 96 which has its maximum rotational speed controlled in a well known manner by the reciprocation of the verge 98. Since the escapement wheel 96 can rotate at a limited speed only, the speed of the rotation of the shaft 92 is controlled.

In using the toy 10, the cover 33 is raised to the vertical to hide the position of the slide 34. The knob 30 is rotated to select a particular vertical angle and the launching assembly 16 is rotated with respect to the base to select a particular horizontal angle. The knob 32 is then rotated to select a particular delay, and the ball 28 is placed on the launcher 24 which is forced to the lowest position. The knob 32 is then depressed engaging the shaft 92 under control of the escapement mechanism. The shaft 92 rotates moving the knob 32 and the trigger 86. The trigger 86 pushes against the projection 84 (after a selected time) moving the arm 78 of the end 76 and releasing the latch 70. The movement of latch 70 allows the rod 18 and the trigger operating device 22 to fall against the detents 46 and 48 causing the surface 64 to contact the slide 60 releasing the trigger 55. With the release of the trigger 55, the platform 25 impels the ring 26 outward in a spiral motion along the rod 18 throwing the ball 28 in the predetermined direction and at the predetermined angle.

The various elements of the ball throwing machine 10 may be, in general, constructed of moldable plastic materials which are well known in the art. For example, the housing 21 may be constructed of high impact polystyrene while the various gears and shafts may be molded of high wear material such as Acetal. The rod 18 may be constructed of steel, and the various springs may be manufactured of selected metals well known to those skilled in the art.

Though a preferred embodiment has been shown and described, it will be obvious to those skilled in the art that various adaptations and modifications might be made to the ball throwing machine without departing from the spirit and scope of the invention.

What is claimed is:

1. A ball throwing machine comprising a base; a rod mounted to be supported by the base; means for selecting a direction in which the rod projects with respect to the base, including means for pre-setting an angle of projection from the vertical, means for holding the rod in the vertical position, means for releasing the rod to free fall from the vertical, means for stopping the fall of the rod when it reaches the pre-set angle of projection; and means for propelling a ball along a path initially defined by the axis of the rod after the rod has reached the stopping means.

2. A ball throwing machine as claimed in claim 1 in which the means for moving a ball along a path initially defined by the axis of the rod comprises a platform surrounding the rod having an upper surface adapted to engage a ball having a cylindrical aperture therein larger than the diameter of the rod, and a spring connecting the platform to one end of the rod.

3. A ball throwing machine as claimed in claim 2 in which the means for moving a ball along a path initially defined by the axis of the rod further comprises means for locking the platform at a number of positions along the rod, and means for releasing the platform from one of the locked positions.

4. A ball throwing machine as claimed in claim 3 further comprising means for actuating the means for releasing the platform from one of the locked positions at the time at which the rod reaches the selected direction of projection.

5. A ball throwing machine as claimed in claim 2 in which the means for moving a ball along a path initially defined by the axis of the rod further comprises a pin projecting from the platform into the rod through a spiral slot disposed along a portion of the length of the rod, the pin connecting the platform to the spring.

6. A ball throwing machine as claimed in claim 1 in which the means for selecting a direction in which the rod projects from the base comprises an assembly connected to the base to rotate on a vertical axis with respect to the base, and means rotatably connecting an end of the rod to the assembly.

7. A ball throwing machine as claimed in claim 1 in which the means for holding the rod in the vertical position comprises a latch rotatably mounted to engage the rod in the vertical position thereof, and means for moving the latch to release the rod.

8. A ball throwing machine comprising a base; a rod mounted to be supported by the base; means for selecting a direction in which the rod projects with respect to the base, including an assembly connected to the base to rotate on a vertical axis with respect to the base, means rotatably connecting an end of the rod to the assembly, means for selecting an angular position at which the rod will come to rest after falling from an initial vertical position, said selecting means including a slide having detents at different vertical levels, the slide being positioned by the assembly in the path of rotation of the rod, means for moving the slide so that said detents stop the falling rod; and means for moving a ball along a path initially defined by the axis of the rod.

9. A ball throwing machine comprising a base; a rod mounted to be supported by the base; means for selecting a direction in which the rod projects with respect to the base, including an assembly connected to the base to rotate on a vertical axis with respect to the base, means rotatably connecting an end of the rod to the assembly, means for selecting an angular position from the vertical at which the rod projects; means for moving a ball along a path initially defined by the axis of the rod; and further comprising means for holding the rod in the vertical position and for releasing the rod so as to permit the rod to fall from the vertical position, said means for holding and releasing including a latch rotatably mounted to engage and hold the rod in the vertical position, said holding and releasing means further including means for removing the latch to release the rod, said holding and releasing means further including a timing mechanism for timing the release of the latch.

10. A ball throwing machine comprising a base; a rod mounted to be supported by the base: means for selecting a horizontal direction in which the rod projects with respect to the base, said means including an assembly connected to the base for rotating about a vertical axis with respect to the base, means pivotably connecting an end of the rod to the assembly, means for selecting an angular position from the vertical at which the rod projects; means for moving a ball along a path initially defined by the axis of the rod, a platform surrounding the rod having an upper surface adapted to engage a ball having a cylindrical aperture therein larger than the diameter of the rod, a spring connecting the platform to one end of the rod; means for holding the rod in the vertical position and for releasing the rod to permit free fall of said rod from the vertical position, a trigger operating device rotatably mounted on the assembly with the rod, the device being operable to release the platform to project a ball when the rod falls to the selected angle from the vertical.

* * * * *